US008752889B1

(12) United States Patent
Nievinski et al.

(10) Patent No.: US 8,752,889 B1
(45) Date of Patent: Jun. 17, 2014

(54) BENCH SYSTEM

(76) Inventors: Joe A. Nievinski, Eland, WI (US); Jason Wojnowiak, Weston, WI (US)

( * ) Notice: Subject to any disclaimer, the term of this patent is extended or adjusted under 35 U.S.C. 154(b) by 320 days.

(21) Appl. No.: 13/243,145

(22) Filed: Sep. 23, 2011

(51) Int. Cl.
*A47C 4/00* (2006.01)

(52) U.S. Cl.
USPC ..... 297/42; 297/44; 297/45; 297/56; 297/184.11; 297/184.14

(58) Field of Classification Search
USPC ..... 297/42, 44, 45, 56, 59, 184.11, 184.14; 135/96
See application file for complete search history.

(56) References Cited

U.S. PATENT DOCUMENTS 925,059 A * 6/1909 Walker ..... 5/113
2,811,977 A * 11/1957 McClish ..... 297/184.14
2,885,688 A * 5/1959 Dyrland ..... 4/476
3,122,397 A * 2/1964 Mintz ..... 297/188.13
3,845,985 A * 11/1974 Behrend et al. ..... 297/184.14
4,083,601 A * 4/1978 McBeth ..... 297/184.14
4,702,029 A 10/1987 DeVaul et al.
4,971,089 A * 11/1990 Braman ..... 135/90
5,062,234 A * 11/1991 Green ..... 43/1
5,419,233 A 5/1995 Mulvaney
5,496,094 A * 3/1996 Schwartzkopf et al. ..... 297/45
5,522,642 A * 6/1996 Herzog ..... 297/344.18
5,542,359 A * 8/1996 Polries ..... 108/26
5,697,180 A 12/1997 Morizio
5,937,883 A * 8/1999 Camara ..... 135/87
5,964,435 A 10/1999 Peltier
6,824,209 B1 * 11/2004 Redzisz et al. ..... 297/45
D500,612 S * 1/2005 Allen et al. ..... D6/417
D546,096 S 7/2007 Kreiss
7,845,717 B2 * 12/2010 Leng ..... 297/16.1

* cited by examiner

*Primary Examiner* — Laurie Cranmer

(57) ABSTRACT

A bench system having a first and second panel mounted atop a first and second leg and a third and fourth leg, the panels are separated by a gap, the first leg and third leg and the second leg and fourth leg are pivotally connected via a pivot component, the legs are adjustable in length via an adjusting means, a sheet atop the panels, straps attached to the sheet at a first and second side, an extension sheet having a first and second side edge, and a top edge, wherein the top edge or a portion thereof is removably attached to the fourth side of the sheet via an attachment means, the first and second side edges of the extension sheet extend past the legs and sheet, and a pole on each side edge of the extension sheet.

5 Claims, 6 Drawing Sheets

BENCH SYSTEM

FIELD OF THE INVENTION

The present invention is directed to a bench system, more particularly to a folding bench system for providing support for a rifle or crossbow user.

BACKGROUND OF THE INVENTION

The present invention features a bench system for providing a convenient resting area for a gun or crossbow while hunting from a blind. The system is stable and adjustable, helping a user keep steady to get an accurate shot. The system can help avoid strain and discomfort, for example for elderly or young users. The system can also be used to store hunting supplies.

SUMMARY

The present invention features a bench system. In some embodiments, the bench system comprises a first panel mounted atop a first leg and a second leg; a second panel mounted atop a third leg and a fourth leg, the first panel and the second panel are separated by a gap, the first leg and the third leg are pivotally connected via a pivot component and the second leg and the fourth leg are pivotally connected via a pivot component, the legs are adjustable in length via an adjusting means; a sheet disposed atop the panels; a first strap attached to the sheet at a first side and a second side, and a second strap attached to the sheet at the first side and the second side; an extension sheet having a first side edge, a second side edge, and a top edge, wherein the top edge or a portion thereof is removably attached to the fourth side of the sheet via an attachment means, the first side edge and the second side edge of the extension sheet extend past the legs and sheet; and a first pole disposed on the first side edge of the extension sheet and a second pole disposed on the second side edge of the extension sheet.

In some embodiments, a gripping component is disposed on bottom ends of each leg. In some embodiments, a first pocket is disposed on the third side of the sheet. In some embodiments, the attachment means comprises a hook-and-loop fastener mechanism, a button mechanism, a snap mechanism, a magnet mechanism, a hook mechanism, a clip mechanism, a latch mechanism, a tie mechanism, a buckle mechanism, or a combination thereof. In some embodiments, cup holder is disposed in the sheet.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIG. 1-5, the present invention features a bench system 100. The system 100 comprises a first panel 110*a* and a second panel 110*b*. The first panel 110*a* is mounted atop a first leg 120*a* and a second leg 120*b*, and the second panel 110*b* is mounted atop a third leg 120*c* and a fourth leg 120*d*. The legs 120 may be positioned at or near the ends of the panels 110. In some embodiments, the first leg 120*a* and the second leg 120*b* are connected (e.g., via a connecting component attached to the bottom surface of the first panel 110*a*. In some embodiments, the third leg 120*c* and the fourth leg 120*d* are connected (e.g., via a connecting component attached to the bottom surface of the second panel 110*b*.

The two panels 110 are separated by a gap.

The first leg 120*a* and the third leg 120*c* are pivotally connected (e.g., at the center regions of the respective legs 120) via a pivot component. The second leg 120*b* and the fourth leg 120*d* are pivotally connected (e.g., at the center regions of the respective legs 120) via a pivot component. As viewed from the sides, the legs can occupy an X-shaped configuration (e.g., see FIG. 2).

Figure 2:
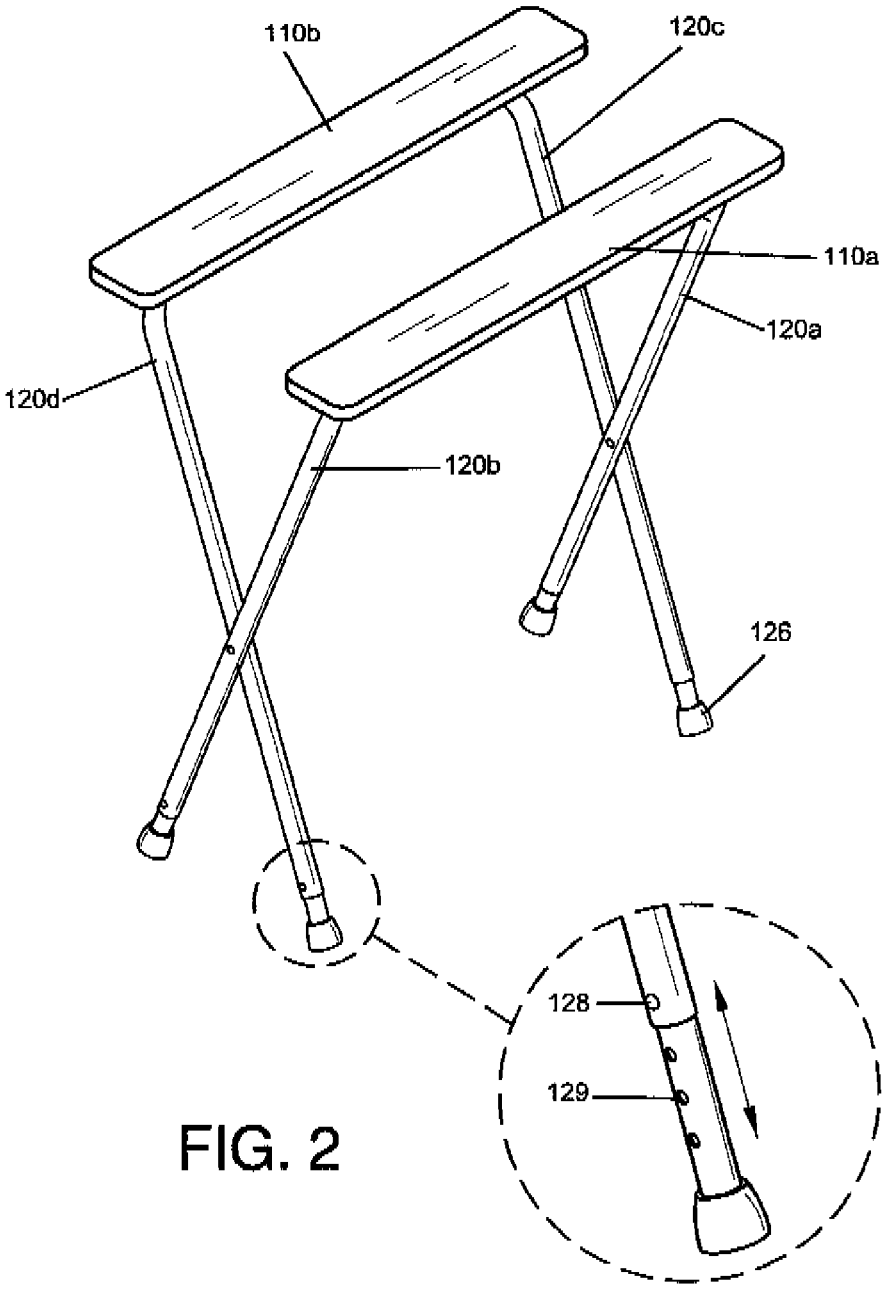
FIG. 2 is an exploded view of the bench system of the present invention.
Figure 3:
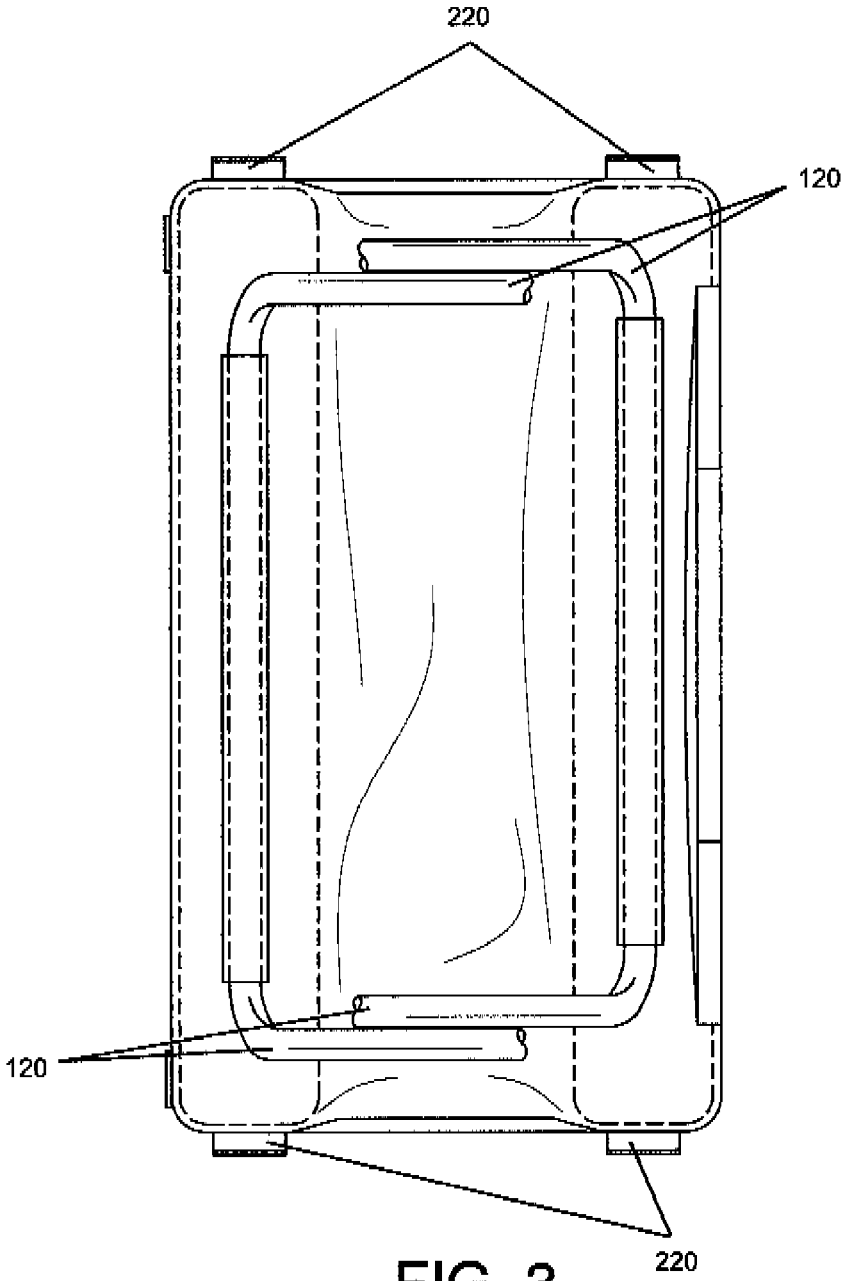
FIG. 3 is a bottom view of the bench system of the present invention.
Figure 4:
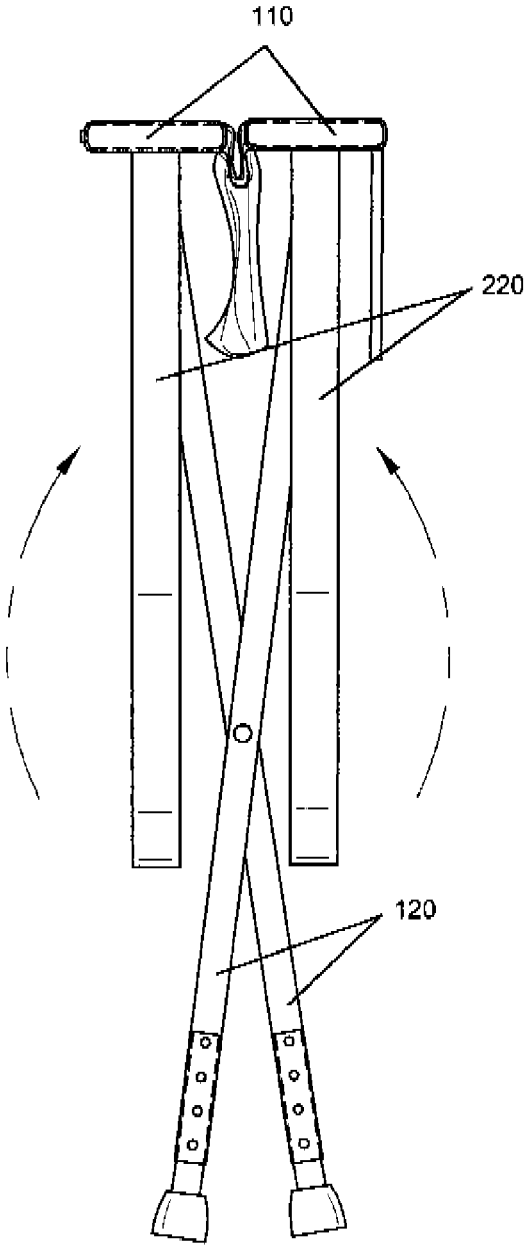
FIG. 4 is a side view of the bench system of the present invention.

The legs 120 are adjustable in length via an adjusting means. Means of adjusting leg length is well known to one of ordinary skill in the art. For example, in some embodiments, the legs 120 are telescopic legs. Telescopic legs are well known to one of ordinary skill in the art. The legs 120 can be secured at a particular length via a securing mechanism (e.g., a pin and aperture mechanism, e.g., see FIG. 2 showing a pin 128 and apertures 129).

In some embodiments, a gripping component 126 (e.g., rubber) is disposed on the bottom ends of each leg 120.

The panels 110 and legs 120 together may resemble a standard luggage stand or luggage rack, which is well known to one of ordinary skill in the art.

Disposed atop the panels 110 is a sheet 210 (e.g., fabric sheet, canvas sheet, etc., the present invention is not limited to the aforementioned materials). The sheet 210 has a first side 211, a second side 212 (opposite the first side 211), a third side, and a fourth side 214. In some embodiments, the sheet 210 comprises a camouflage design. The present invention is not limited to the aforementioned designs.

A first strap 220*a* is attached to the sheet 210, e.g., at the first side 211 and the second side 212, e.g., at or near the third side 213. A second strap 220*b* is attached to the sheet 210, e.g., at the first side 211 and the second side 212, e.g., at or near the fourth side 214.

Figure 5:
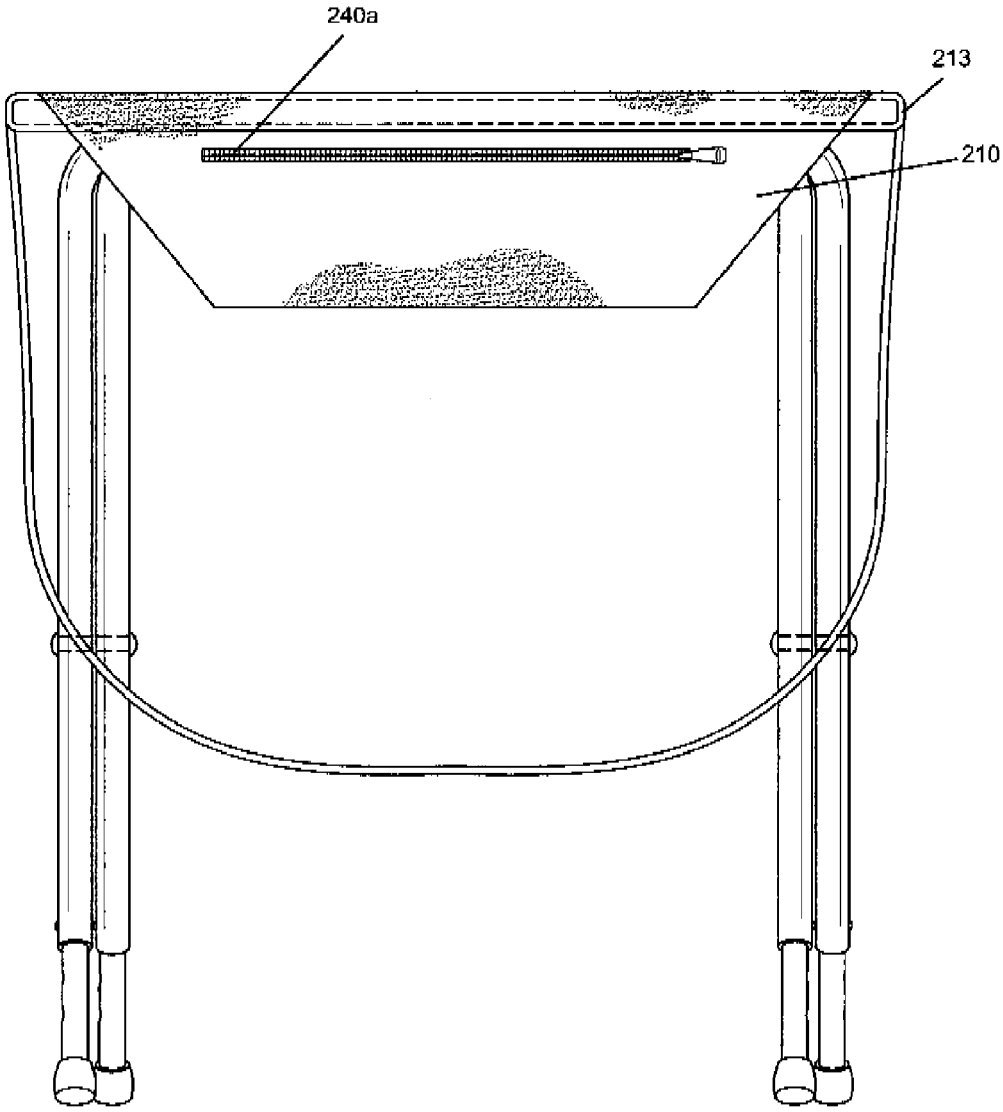
FIG. 5 is a front view of the bench system of the present invention.

As shown in FIG. 5, a first pocket 240*a* (e.g., zippered pocket) may be attached to and extend downwardly from the third side 213 of the sheet 210. In some embodiments, the system 100 comprises a second pocket extending from the fourth side 214 of the sheet 210.

Figure 1:
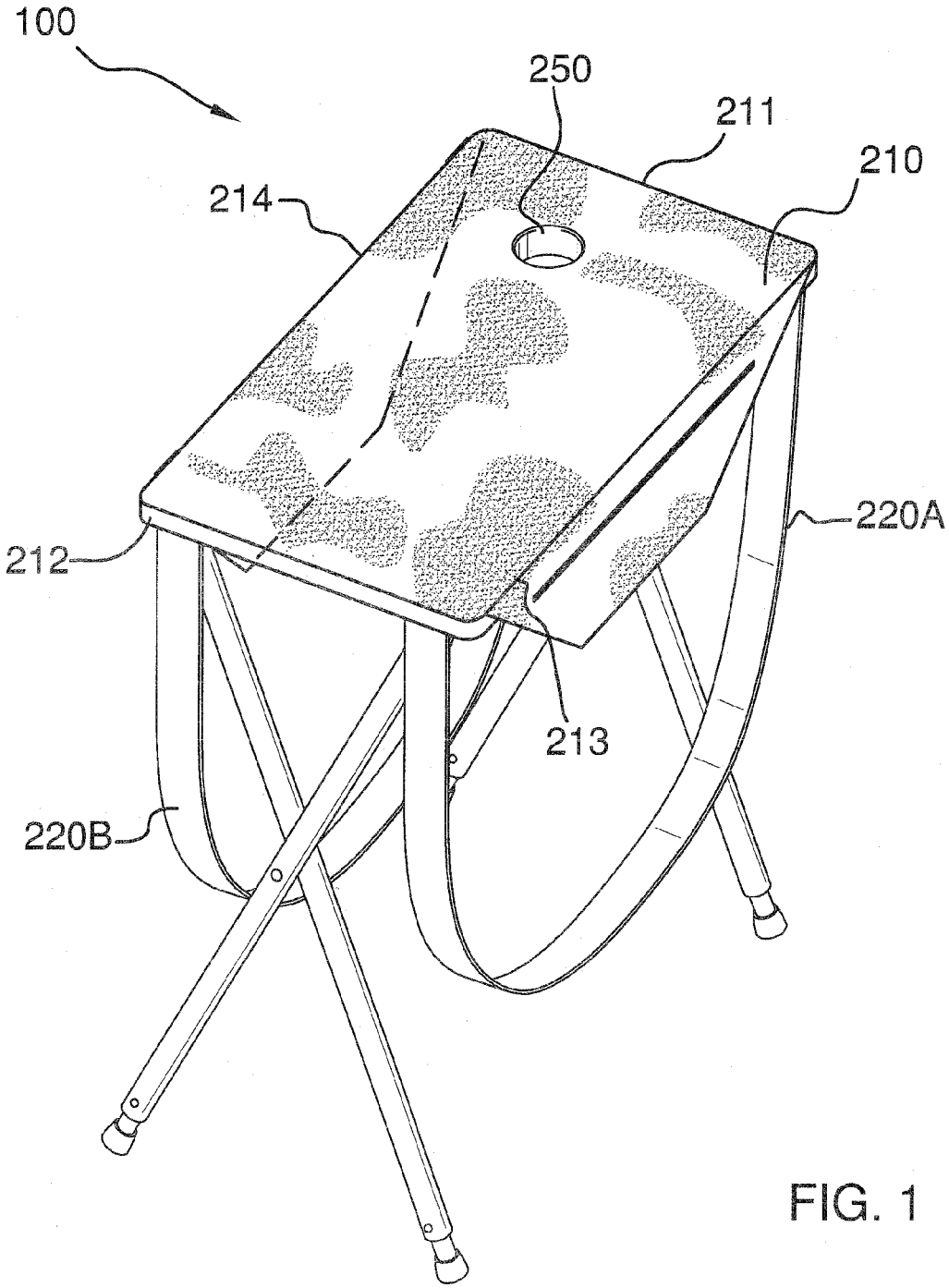
FIG. 1 is a perspective view of the bench system of the present invention.

As shown in FIG. 1, a cup holder 250 may be disposed in the sheet 210. Cup holders are well known to one of ordinary skill in the art.

Figure 1A:
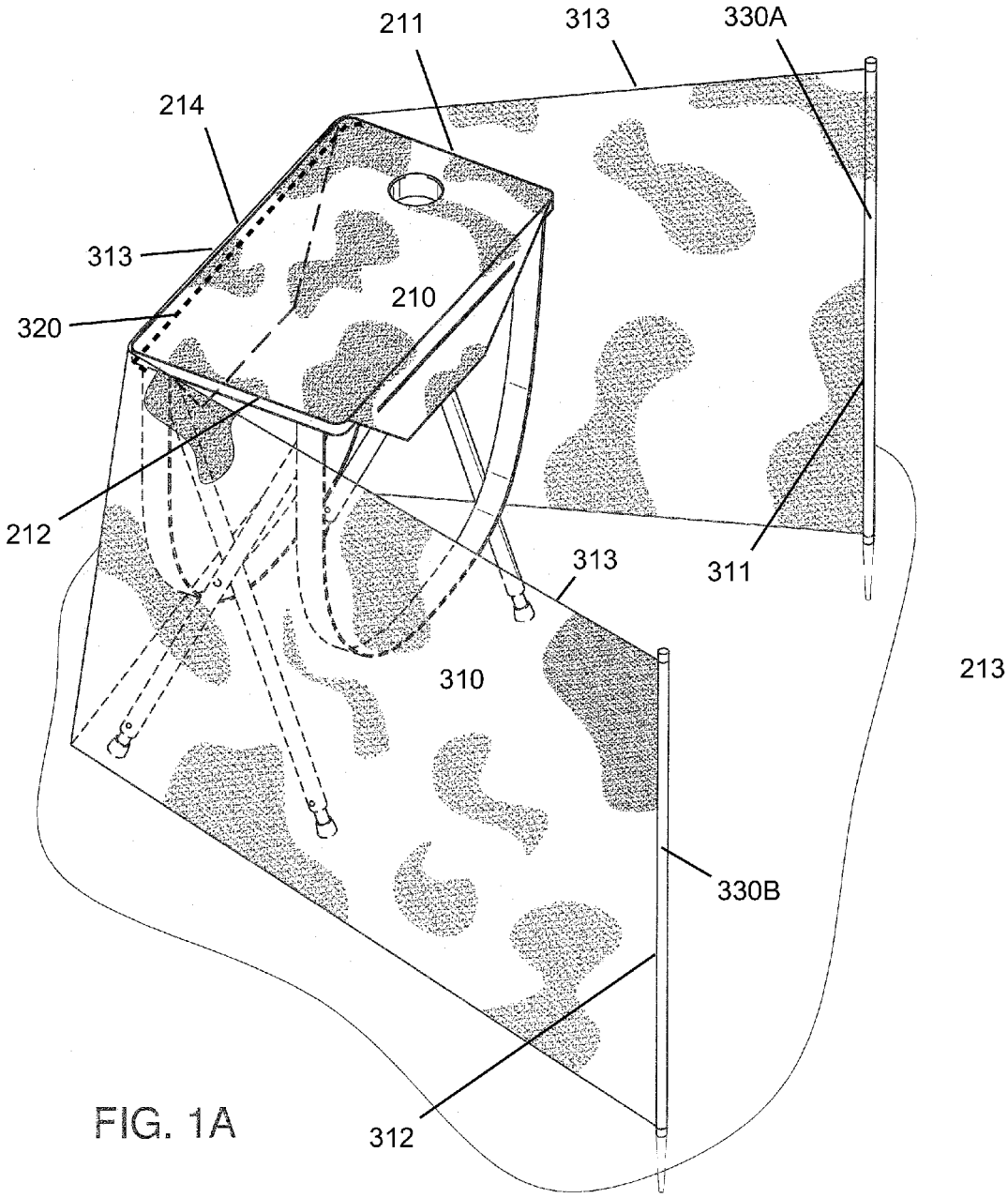
FIG. 1A is a perspective view of the bench system with the blind of the present invention.

As shown in FIG. 1A, the system 100 further comprises an extension sheet 310. The extension sheet 310 has a first side edge 311, a second side edge 312, and a top edge 313. The top edge 313 or a portion thereof is removably attached to the fourth side 214 of the sheet 210 or to the first panel 110*a* via an attachment means 320. The attachment means 320 may include but is not limited to a hook-and-loop fastener mechanism, a button mechanism, a snap mechanism, a magnet mechanism, a hook mechanism, a clip mechanism, a latch mechanism, a tie mechanism, a buckle mechanism, the like, or a combination thereof. The first side edge 311 and the second side edge 312 of the extension sheet 310 extend past the legs 120 and sheet 210.

As shown in FIG. 1A, a first pole 330*a* is disposed on the first side edge 311 of the extension sheet 310. A second pole 330*b* is disposed on the second side edge 312 of the extension sheet 310. The poles 330 allow the extension sheet 310 to be secured in a particular position. For example, the poles 330 can be driven into the ground surface.

In some embodiments, the extension sheet 310 comprises a camouflage design.

The system 100 may be constructed in a variety of sizes. For example, in some embodiments, the panels 110 are between about 1 to 3 feet (e.g., 2 feet) in length as measured from the first end to the second end. In some embodiments, the panels 110 are less than about 1 foot in length. In some embodiments, the panels 110 are more than about 3 feet in length. The present invention is not limited to the aforementioned dimensions.

As used herein, the term "about" refers to plus or minus 10% of the referenced number. For example, an embodiment wherein the panels 110 are about 2 feet in length includes panels that are between 1.8 and 2.2 feet in length.

The disclosures of the following U.S. Patents are incorporated in their entirety by reference herein: U.S. Pat. No. 4,702,029; U.S. Pat. No. 5,419,233; U.S. Pat. No. 5,542,359; U.S. Pat. No. 5,697,180; U.S. Pat. No. 5,984,435; U.S. Design Pat. No. D546096.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A bench system 100 comprising:

(a) a first panel 110*a* mounted atop a first leg 120*a* and a second leg 120*b;*

(b) a second panel 110*b* mounted atop a third leg 120*c* and a fourth leg 120*d*, the first panel 110*a* and the second panel 110*b* are separated by a gap, the first leg 120*a* and the third leg 120*c* are pivotally connected via a pivot component and the second leg 120*b* and the fourth leg 120*d* are pivotally connected via a pivot component, the legs 120 are adjustable in length via an adjusting means, wherein the first panel 110*a* and the second panel 110*b* are hereinafter referred to as panels 110;

(c) a sheet 210 disposed atop the panels 110;

(d) a first strap 220*a* attached to the sheet 210 at a first side 211 and a second side 212, and a second strap 220*b* attached to the sheet 210 at the first side 211 and the second side 212;

(e) an extension sheet 310 having a first side edge 311, a second side edge 312, and a top edge 313, wherein the top edge 313 or a portion thereof is removably attached to a fourth side 214 of the sheet 210 via an attachment means 320, the first side edge 311 and the second side edge 312 of the extension sheet 310 extend past the legs 120 and sheet 210; and (f) a first pole 330*a* disposed on the first side edge 311 of the extension sheet 310 and a second pole 330*b* disposed on the second side edge 312 of the extension sheet 310;

wherein a cup holder 250 is disposed in the sheet 210.

2. The system 100 of claim 1, wherein a gripping component 126 is disposed on bottom ends of each leg 120.

3. The system 100 of claim 1, wherein a first pocket 240*a* is disposed on a third side 213 of the sheet 210.

4. The system 100 of claim 1, wherein the attachment means 320 comprises a hook-and-loop fastener mechanism, a button mechanism, a snap mechanism, a magnet mechanism, a hook mechanism, a clip mechanism, a latch mechanism, a tie mechanism, a buckle mechanism, or a combination thereof.

5. A bench system 100 consisting of:

(a) a first panel 110*a* mounted atop a first leg 120*a* and a second leg 120*b;*

(b) a second panel 110*b* mounted atop a third leg 120*c* and a fourth leg 120*d*, the first panel 110*a* and the second panel 110*b* are separated by a gap, the first leg 120*a* and the third leg 120*c* are pivotally connected via a pivot component and the second leg 120*b* and the fourth leg 120*d* are pivotally connected via a pivot component, the legs 120 are adjustable in length via an adjusting means, wherein the first panel 110*a* and the second panel 110*b* are hereinafter referred to as panels 110;

(c) a sheet 210 disposed atop the panels 110;

(d) a first strap 220*a* attached to the sheet 210 at a first side 211 and a second side 212, and a second strap 220*b* attached to the sheet 210 at the first side 211 and the second side 212;

(e) an extension sheet 310 having a first side edge 311, a second side edge 312, and a top edge 313, wherein the top edge 313 or a portion thereof is removably attached to a fourth side 214 of the sheet 210 via an attachment means 320, the first side edge 311 and the second side edge 312 of the extension sheet 310 extend past the legs 120 and sheet 210; and (f) a first pole 330*a* disposed on the first side edge 311 of the extension sheet 310 and a second pole 330*b* disposed on the second side edge 312 of the extension sheet 310;

wherein a cup holder 250 is disposed in the sheet 210.

* * * * *